US008342645B2

(12) United States Patent
Tomizawa et al.

(10) Patent No.: US 8,342,645 B2
(45) Date of Patent: Jan. 1, 2013

(54) PRINTING APPARATUS AND CONTROL METHOD THEREFOR

(75) Inventors: Keiji Tomizawa, Yokohama (JP); Masaki Oikawa, Inagi (JP); Masayuki Kyoshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 357 days.

(21) Appl. No.: 12/768,924

(22) Filed: Apr. 28, 2010

(65) Prior Publication Data

US 2010/0289843 A1 Nov. 18, 2010

(30) Foreign Application Priority Data

May 14, 2009 (JP) ..... 2009-118038

(51) Int. Cl.
*B41J 2/15* (2006.01)

(52) U.S. Cl. ..... 347/41; 347/12; 347/39

(58) Field of Classification Search ..... None
See application file for complete search history.

(56) References Cited

U.S. PATENT DOCUMENTS

2008/0012924 A1 1/2008 Moriyama et al.
2009/0189948 A1* 7/2009 Nakata ..... 347/37

FOREIGN PATENT DOCUMENTS

JP 2005-144724 A 6/2005
JP 2006-175744 A 7/2006

OTHER PUBLICATIONS

Machine translation of JP 2005-144724 A. (JP 2005-144724 A was published on Jun. 9, 2005).*

* cited by examiner

*Primary Examiner* — Matthew Luu
*Assistant Examiner* — Justin Seo
(74) *Attorney, Agent, or Firm* — Fitzpatrick, Cella, Harper & Scinto

(57) ABSTRACT

A printing apparatus prints on a printing medium by scanning a printhead having a plurality of nozzle arrays in a first direction and a second direction opposite to the first direction, and has a structure in which an air flow entering the nozzle array in the scan of the printhead in the first direction becomes larger than an air flow entering the nozzle array in the scan of the printhead in the second direction. The apparatus increases, in scanning in the second direction, discharge speed of ink discharged from at least one nozzle array arranged leeward in the scanning direction of the printhead from a predetermined position on the printhead in the scanning direction to be higher than or equal to the discharge speed of ink discharged from at least one nozzle array arranged windward in the scanning direction of the printhead from the predetermined position.

8 Claims, 20 Drawing Sheets

| | | FORWARD PRINTING | | BACKWARD PRINTING | | VARIATIONS OF MAIN-SATELLITE DISTANCE Range [um] |
|---|---|---|---|---|---|---|
| | | L ARRAY | R ARRAY | L ARRAY | R ARRAY | |
| NO v CONTROL | DISCHARGE SPEED [m/s] | 11 | 11 | 11 | 11 | 8 DECREASED |
| | MAIN-SATELLITE DISTANCE [um] | 39 | 47 | 40 | 36 | |
| v CONTROL | DISCHARGE SPEED [m/s] | 12 | 15 | 12 | 11 | 3 |
| | MAIN-SATELLITE DISTANCE [um] | 37 | 37 | 34 | 36 | |

HEAD-SHEET DISTANCE = 1.2mm

| | | FORWARD PRINTING | | BACKWARD PRINTING | | VARIATIONS OF MAIN-SATELLITE DISTANCE Range [um] |
|---|---|---|---|---|---|---|
| | | L ARRAY | R ARRAY | L ARRAY | R ARRAY | |
| NO v CONTROL | DISCHARGE SPEED [m/s] | 11 | 11 | 11 | 11 | 8 |
| | MAIN-SATELLITE DISTANCE [um] | 39 | 47 | 40 | 36 | |
| v CONTROL | DISCHARGE SPEED [m/s] | 12 | 15 | 12 | 11 | 3 |
| | MAIN-SATELLITE DISTANCE [um] | 37 | 37 | 34 | 36 | |

DECREASED

HEAD-SHEET DISTANCE = 1.2mm

PRINTING APPARATUS AND CONTROL METHOD THEREFOR

BACKGROUND OF THE INVENTION

1. Field of the Invention

The present invention relates to a printing apparatus and control method therefor.

2. Description of the Related Art

There is known a printing apparatus which prints information such as text or images on a printing medium. The printing method is, for example, an inkjet printing method of printing with ink. A discharge energy generation element used to discharge ink is, for example, a heat generation element such as a heater, or a piezoelectric element. Any method using such a discharge energy generation element controls discharge of an ink droplet based on an electrical signal.

According to a method using the heat generation element, a voltage is applied to the heat generation element, instantaneously boiling ink near it. An ink droplet is discharged by an abrupt blowing pressure generated by a phase change of ink upon boiling (Japanese Patent Laid-Open No. 2006-175744). In contrast, according to a method using the piezoelectric element, a voltage is applied to the piezoelectric element to displace it. An ink droplet is discharged by a pressure generated upon displacement.

When printing on a low-quality printing medium such as plain paper using a printhead adopting either method described above, so-called low-pass printing is executed to complete printing on the same printing area on the printing medium in, for example, one to four scan operations. When printing on a high-quality printing medium such as a photo medium, so-called multi-pass printing is done to complete printing on the same printing area on the printing medium in, for example, four to 24 scan operations. The multi-pass method can reduce printing variations and improve print quality.

Recently, higher speed and higher quality print processing is being pursued in order to meet an increasing demand for photo printing. High-speed printing, that is, low-pass printing is required even for high-quality media.

When print processing is performed quickly for a high-quality medium using low-pass printing, print quality is satisfactory with even numbers of passes such as four, six, or eight; however, results are poor on odd numbers of passes such as one, three, or five. More specifically, band-like (to be also referred to as a band) nonuniformity is generated.

This mechanism will be explained. Ink discharged from each nozzle array of the printhead has a velocity component accompanying scanning of the printhead. In addition, the ink is affected by an air flow (called a Couette flow) generated when the head surface is moved along with the scanning of the printhead. Discharged ink including a main droplet and satellite flies in the printhead scanning direction.

The printhead is scanned within the apparatus, that is, a closed space. An air flow swept away by the scanning of the printhead is reflected by the wall surface of the apparatus and enters the interval between the printhead and the printing medium as an incoming air flow. The incoming air flow is generally asymmetrical in volume between forward printing and backward printing. This is because the internal structure of the printing apparatus and the structure of the printhead are horizontally asymmetrical in the printhead scanning direction. Due to the incoming air flow, the distance between the main droplet and the satellite (to be also referred to as a main-satellite distance) differs between forward printing and backward printing.

FIG. 11A shows a case in which an incoming air flow generated in backward printing is larger than that generated in forward printing. In this case, the main droplet and satellite are swept back in a direction opposite to the scanning direction much more in backward printing than in forward printing. In particular, small volume satellites are largely swept back in the direction opposite to the scanning direction. As a result, in reciprocal scanning, the main-satellite distance differs between nozzle arrays on the upstream side (windward) in the printhead moving direction (scanning direction), or those on the downstream side (leeward) in the printhead moving direction.

From a comparison between windward and leeward nozzle arrays in forward printing and backward printing, the main-satellite distance of the windward nozzle array is shorter in the two cases. This is because an incoming air flow blowing into the leeward nozzle array is much more attenuated than that blowing into the windward nozzle array, and the distance by which the main droplet and satellite are swept back in the direction opposite to the scanning direction decreases.

A flow velocity distribution shown in, for example, FIG. 11B affects ink discharged from each nozzle array of the printhead. As shown in FIG. 11B, a Couette flow generated in the printhead scanning direction is swept back by an incoming air flow in the direction opposite to the scanning direction. Flow velocity distributions different between the forward and backward directions and between the windward and leeward nozzle arrays act on inks discharged from the respective nozzle arrays of the printhead.

More specifically, the incoming air flow pushes the Couette flow most for the R array positioned windward in backward printing. The flying distance of a main droplet and satellite discharged from the R array in the printhead scanning direction becomes relatively small. In contrast, the incoming air flow is attenuated for the R array positioned leeward in forward printing. Thus, the distance by which the main droplet and satellite are swept back by the incoming air flow becomes very short, and only the Couette flow acts substantially. As a result, a main droplet and satellite discharged from the R array positioned leeward in forward printing fly by a relatively large distance in the printhead scanning direction.

FIG. 11C shows parts of the L and R nozzle arrays of the printhead and the image of bands adjacent in the printing medium conveyance direction upon printing with these nozzle arrays. When the printhead having this arrangement executes reciprocal scanning using an odd number of passes (e.g., 3-pass reciprocal printing), a band formed by "forward 1→backward 1→forward 2 (numerals after "forward" and "backward" indicate turns of scanning)" and one formed by "backward 1→forward 2→backward 2" are adjacent to each other. More specifically, these bands adjacent to each other in the printing medium conveyance direction are different in pass in forward printing and backward printing. The difference in pass results in the above-mentioned nonuniformity. This is because, in between bands formed by odd number of passes, difference in how the area factors are filled by main droplets and satellites is generated. The difference in the number of gaps leads to a difference in density between adjacent bands, generating band nonuniformity.

SUMMARY OF THE INVENTION

The present invention provides a technique of suppressing band nonuniformity arising from the difference in incoming air flow between forward printing and backward printing.

According to a first aspect of the present invention there is provided a printing apparatus comprising: a printing unit configured to print on a printing medium by scanning a printhead having a plurality of nozzle arrays in a first direction and a second direction opposite to the first direction, a holding unit configured to hold information regarding an air flow in the scan of the first direction and in the scan of the second direction; and a changing unit configured to change discharge speeds of ink from the plurality of nozzle arrays based on the information regarding the air flow that is held in the holding unit and a scanning direction of the printhead, wherein the printing apparatus has a structure in which an air flow entering the nozzle array in the scan of the printhead in the first direction becomes larger than an air flow entering the nozzle array in the scan of the printhead in the second direction, and in scanning in the second direction, the changing unit increases the discharge speed of ink discharged from at least one nozzle array arranged leeward in the scanning direction of the printhead from a predetermined position on the printhead in the scanning direction to be higher than or equal to the discharge speed of ink discharged from at least one nozzle array arranged windward in the scanning direction of the printhead from the predetermined position.

According to a second aspect of the present invention there is provided a control method for a printing apparatus comprising: printing on a printing medium by scanning a printhead having a plurality of nozzle arrays in a first direction and a second direction opposite to the first direction, holding information regarding an air flow in the scan of the first direction and in the scan of the second direction; and changing discharge speeds of ink from the plurality of nozzle arrays based on the held information regarding the air flow and a scanning direction of the printhead, wherein the printing apparatus has a structure in which an air flow entering the nozzle array in the scan of the printhead in the first direction becomes larger than an air flow entering the nozzle array in the scan of the printhead in the second direction, and in the changing, in scanning in the second direction, the discharge speed of ink discharged from at least one nozzle array arranged leeward in the scanning direction of the printhead from a predetermined position on the printhead in the scanning direction is increased to higher than or equal to the discharge speed of ink discharged from at least one nozzle array arranged windward in the scanning direction of the printhead from the predetermined position.

Further features of the present invention will be apparent from the following description of exemplary embodiments with reference to the attached drawings.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Preferred embodiments of the present invention will be described in detail below with reference to the accompanying drawings. In the following description, a printing apparatus using an inkjet printing method will be exemplified. The printing apparatus using the inkjet printing method may be, for example, a single-function printer having only a print function, or a multi-function printer having a plurality of functions including a print function, FAX function, and scanner function. Also, the printing apparatus using the inkjet printing method may be a manufacturing apparatus for manufacturing a color filter, electronic device, optical device, microstructure, or the like by the inkjet printing method.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

Also, a "nozzle" generically means an orifice, a liquid channel which communicates with it, and an element which generates energy used for ink discharge, unless otherwise specified.

Figure 1:
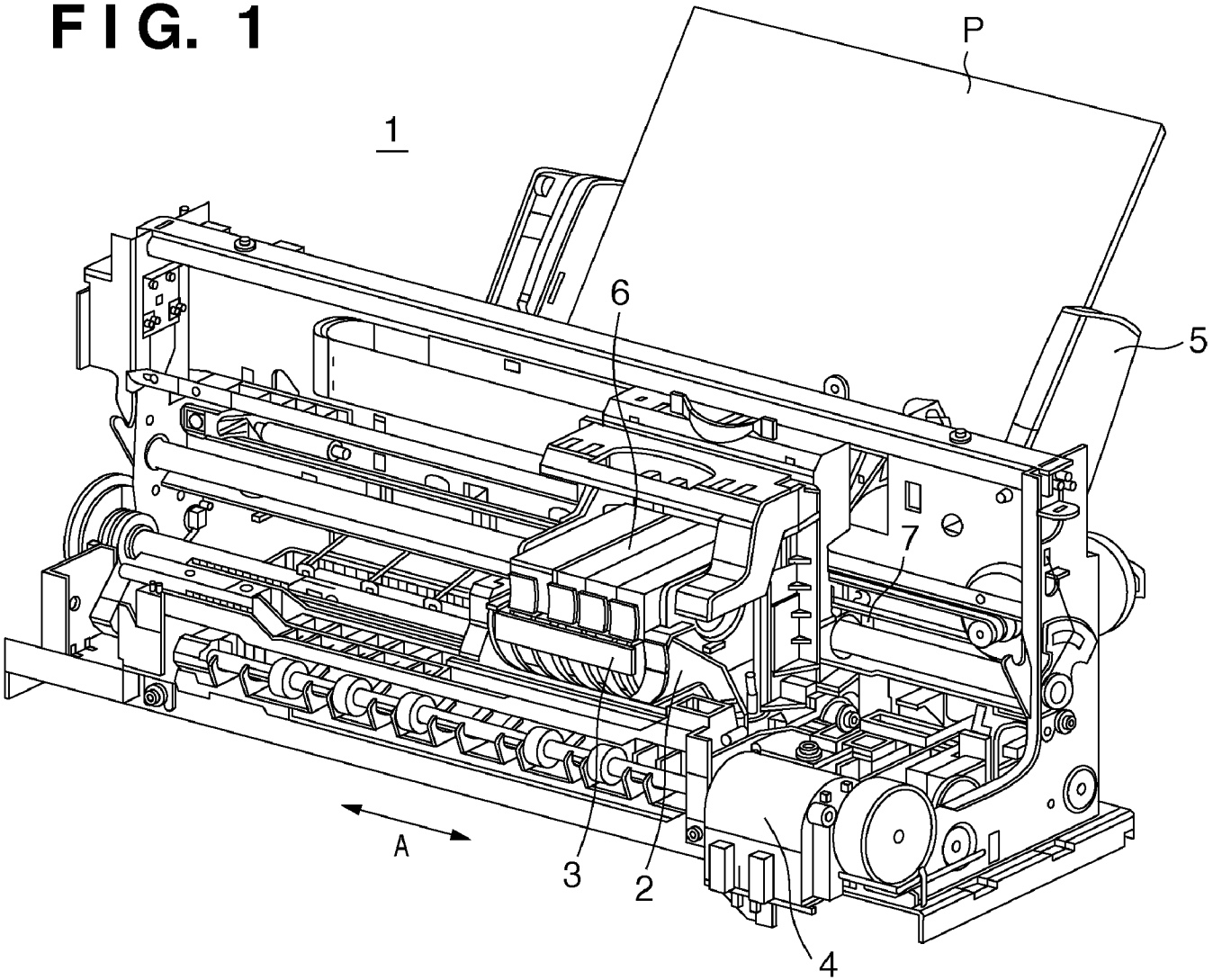
FIG. 1 is a perspective view showing an example of the outer arrangement of an inkjet printing apparatus (to be referred to as a printing apparatus) 1 according to one embodiment of the present invention.

FIG. 1 is a perspective view showing an example of the outer arrangement of an inkjet printing apparatus 1 according to one embodiment of the present invention.

The inkjet printing apparatus (to be simply referred to as a printing apparatus hereinafter) 1 includes an inkjet printhead (to be simply referred to as a printhead hereinafter) 3 which is mounted on a carriage 2 and prints by discharging ink in accordance with the inkjet scheme. The printing apparatus 1 prints by reciprocally moving the carriage 2 in the direction indicated by the two-headed arrow A. The printing apparatus 1 supplies a printing medium P such as a printing sheet via a sheet supply mechanism 5 and conveys it to the printing position. The printing apparatus 1 prints at the printing position by discharging ink from the printhead 3 to the printing medium P.

The carriage 2 of the printing apparatus 1 mounts, for example, an ink cartridge 6, in addition to the printhead 3. The ink cartridge 6 stores ink to be supplied to the printhead 3. Note that the ink cartridge 6 is detachable from the carriage 2. The printing apparatus 1 shown in FIG. 1 can print in color. For this reason, the carriage 2 mounts four ink cartridges which respectively store magenta (M), cyan (C), yellow (Y), and black (K) inks. These four ink cartridges can be independently attached/detached.

The printhead 3 includes a plurality of nozzle arrays. The printhead 3 adopts, for example, an inkjet method of discharging ink using thermal energy. The printhead 3 therefore comprises printing elements (to be referred to as heaters) each formed from a heat generation element, and a heater driving circuit. The heater is arranged in correspondence with each nozzle (orifice). A pulse voltage is applied to a corresponding heater in accordance with a print signal, discharging ink from the nozzle. As the ink discharge method, the embodiment will explain a case in which ink is discharged using the heater, but the present invention is not limited to this. For example, the present invention may employ various inkjet methods such as one using a piezoelectric element, one using an electrostatic element, and one using a MEMS element.

A recovery device 4 is arranged outside the reciprocal movement of the carriage 2 (outside the printing area) to recover the printhead 3 from a discharge failure. The position where the recovery device 4 is arranged is called a home position. The printhead 3 stands still at this position when no printing operation is executed. A direction in which the printhead 3 moves apart from the home position along the carriage 2 will be defined as the forward direction. A direction in which the printhead 3 comes closer to the home position along the carriage 2 will be defined as the backward direction.

The printing apparatus 1 prints by, for example, scanning the same printing area on a printing medium an odd number of times (odd number of passes). At this point, an incoming air flow is generated along with the scanning of the printhead 3. More specifically, an air flow swept away by the scanning of the printhead 3 is reflected by the wall surface of the apparatus and enters the interval between the printhead and the printing medium, generating an air flow (incoming air flow).

The printing apparatus 1 has a structure in which an incoming air flow upon scanning the printhead 3 in the first direction (backward direction in the embodiment) becomes larger than that upon scanning the printhead 3 in the second direction (forward direction in the embodiment). The incoming air flow becomes strongest for a windward nozzle array (R array) in the backward direction, and weakest for a leeward nozzle array (R array) in the forward direction.

Figure 2:
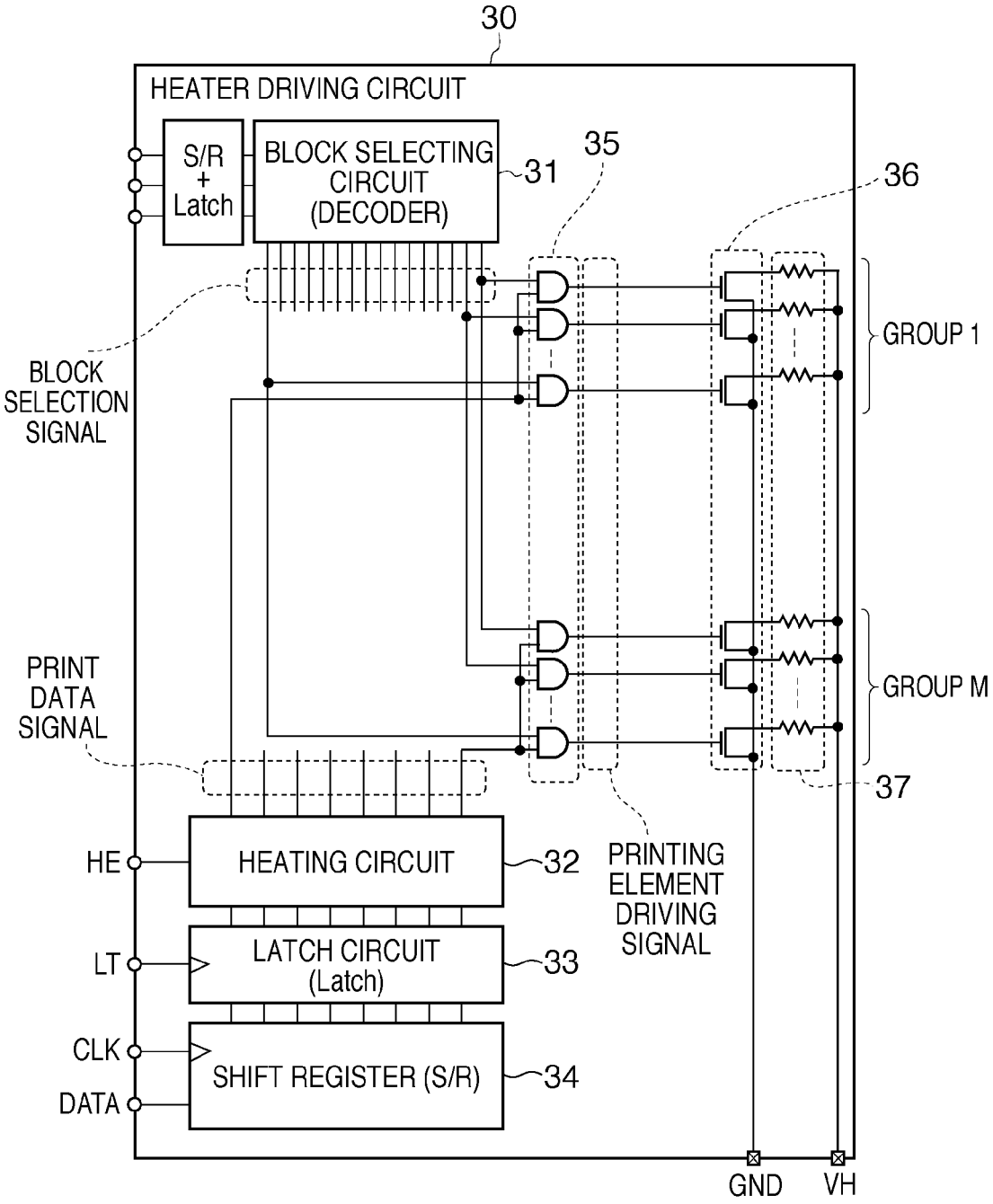
FIG. 2 is a diagram showing an example of the arrangement of a heater driving circuit 30 arranged on the head substrate of a printhead 3 shown in FIG. 1.

The arrangement of a heater driving circuit 30 arranged on the head substrate of the printhead 3 shown in FIG. 1 will be exemplified with reference to FIG. 2.

Each heater 37 generates thermal energy used to discharge ink. Each switching element 36 supplies a current to a corresponding heater 37 to drive it. A shift register (S/R) 34 temporarily stores print data. A latch circuit 33 latches print data stored in the shift register 34 at once. A block selecting circuit (decoder) 31 selects one of N blocks each formed from the heater 37 and switching element 36. Each printing element selecting circuit (heater selecting circuit) 35 uniquely selects an arbitrary heater 37.

N heaters 37, N switching elements 36, and N heater selecting circuits 35 form one group. The heater driving circuit 30 has M groups 1 to M each formed from N elements of each kind. The heater driving circuit 30 receives a clock signal CLK from the apparatus main body, and receives an M-bit print data signal in synchronism with the clock signal CLK. At this time, M bits of the print data signal are sequentially stored in the shift register 34, and the latch circuit 33 latches the data in accordance with a latch signal. At this time, the block selecting circuit 31 also receives a signal. The block selecting circuit 31 converts the input signal into N block selection signals and inputs them to groups 1 to M.

The heater selecting circuits 35 OR M print data signals and N block selection signals in a matrix, and selects M×N heaters 37 in accordance with the result. This operation is repeated N times, driving M×N heaters 37 in time series for every M heaters 37 at N timings. More specifically, in the heater driving circuit 30, M×N heaters 37 are divided into M groups each including N heaters 37. The time of one sequence is divided into N timings so that two or more heaters in a group are not driven simultaneously. Control is performed to drive the heaters 37 within the divided time in accordance with M-bit image data.

Figure 3:
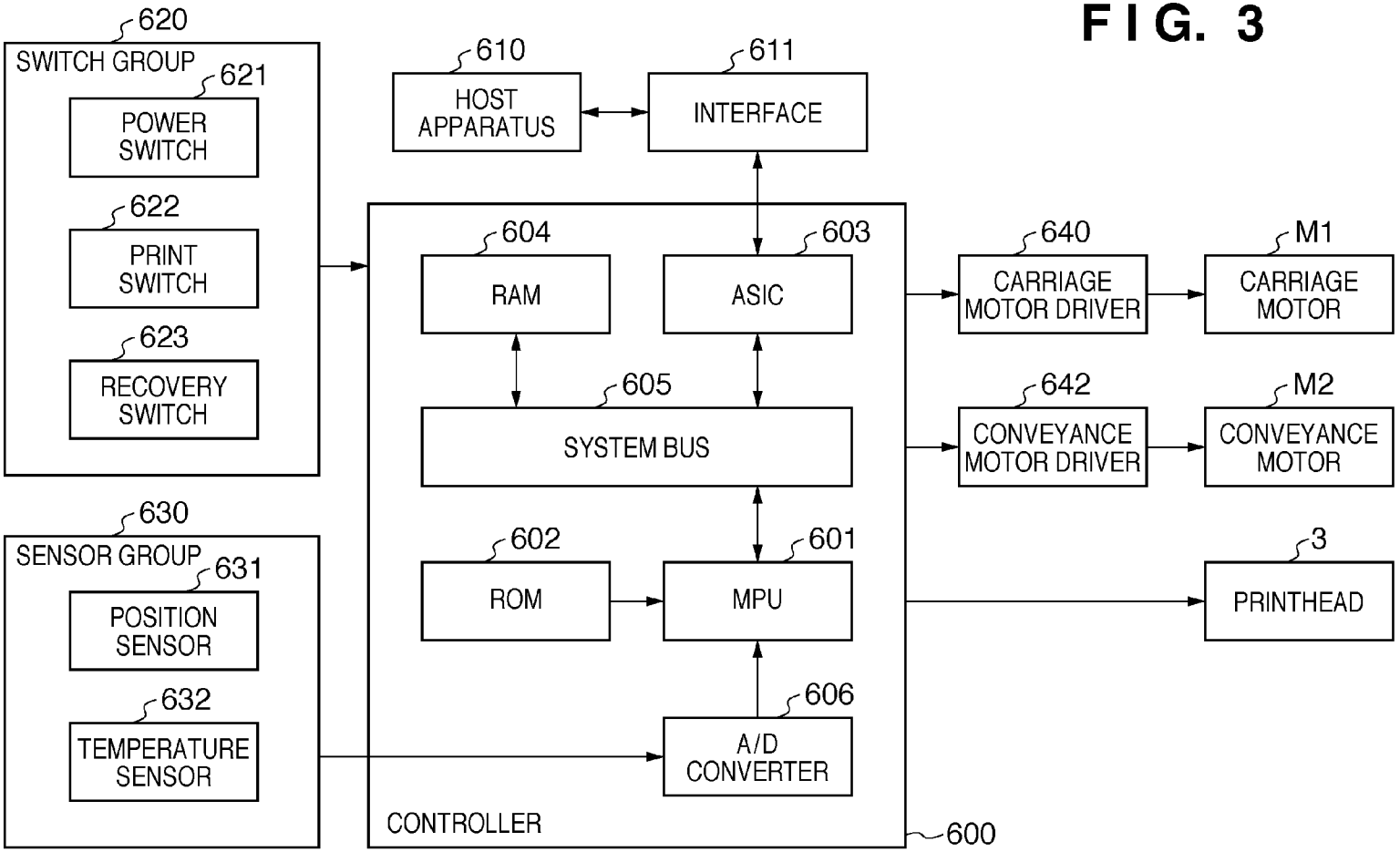
FIG. 3 is a block diagram showing an example of the functional arrangement of the printing apparatus 1 shown in FIG. 1.

The functional arrangement of the printing apparatus 1 shown in FIG. 1 will be exemplified with reference to FIG. 3.

A controller 600 includes an MPU 601, ROM 602, application specific integrated circuit (ASIC) 603, RAM 604, system bus 605, and A/D converter 606. The ROM 602 stores programs corresponding to control sequences (to be described later), predetermined tables, and other permanent data. The RAM 604 or ROM 602 also functions as a holding unit which holds information regarding the incoming air flow described above. The information regarding the incoming air flow serves as a determination criterion when controlling the ink discharge speed considering the influence of the incoming air flow. As the information regarding the incoming air flow, for example, an incoming air flow rate (or ink discharge speed) is held in correspondence with the scanning direction (forward or backward) and the nozzle array position (windward or leeward).

The embodiment uses the Stokes approximation to theoretically derive the distance by which the main droplet and satellite fly in the printhead scanning direction due to a composite flow (Couette-Poiseuille flow) of a Couette flow generated when scanning the printhead and a Poiseuille flow entering the interval between the printhead and the sheet. An incoming air flow is calculated based on the derived theoretical formula and the distance (main-satellite distance) between an actually printed main droplet and satellite. Physical quantities necessary for the theoretical formula are the air viscosity, ink specific gravity, distance between sheets, scanning speed, Vd, main droplet initial velocity, main droplet diameter, satellite initial velocity, satellite diameter, and the like. In the present embodiment, the air viscosity is cited from a chronological scientific table. As for the ink specific gravity, distance between sheets, scanning speed, Vd, main droplet initial velocity, main droplet diameter, satellite initial velocity, and satellite diameter, values actually measured by measuring devices are used.

The ASIC 603 controls a carriage motor M1 and conveyance motor M2. Also, the ASIC 603 generates a control signal for controlling the printhead 3. The RAM 604 is used as an image data rasterization area, a work area for executing a program, and the like. The system bus 605 connects the MPU 601, ASIC 603, and RAM 604 to each other so as to exchange data. The A/D converter 606 A/D-converts an analog signal input from a sensor group (to be described later), and supplies the converted digital signal to the MPU 601.

A switch group 620 includes a power switch 621, print switch 622, and recovery switch 623. A sensor group 630 for detecting the apparatus state includes a position sensor 631 and temperature sensor 632. In scanning the printhead 3, the ASIC 603 transfers data to the printhead 3 to drive the heaters while directly accessing the storage area of the RAM 604.

The carriage motor M1 is a driving source for reciprocating the carriage 2 in predetermined directions. A carriage motor driver 640 controls driving of the carriage motor M1. The conveyance motor M2 is a driving source for conveying a printing medium. A conveyance motor driver 642 controls driving of the conveyance motor M2. The printhead 3 is scanned in a direction (scanning direction) perpendicular to the printing medium conveyance direction.

A computer 610 (or a reader for reading an image or a digital camera) serves as an image data supply source and is called a host apparatus or the like. The host apparatus 610 and printing apparatus 1 exchange image data, commands, status signals, and the like via an interface (to be referred to as an I/F) 611.

(First Embodiment)

Discharge control according to the first embodiment will now be explained. As described above, in a printing apparatus 1, the maximum incoming air flow is generated on the windward (R array) in the backward direction, and the minimum incoming air flow is generated on the leeward (R array) in the forward direction. The first embodiment will exemplify a case in which the incoming air flow has a relationship "windward in the backward direction>windward in the forward direction>leeward in the backward direction>leeward in the forward direction". Note that a windward nozzle array (to be also simply referred to as the windward) means one or a plurality of nozzle arrays arranged on a side in the scanning direction (upstream in the printhead moving direction) from a predetermined position on the printhead. A leeward nozzle array (to be also simply referred to as the leeward) means one or a plurality of nozzle arrays arranged on a side in a direction (downstream in the printhead moving direction) opposite to the scanning direction of a printhead 3 from the predetermined position on the printhead. In the first embodiment, the predetermined position is a nozzle array for discharging magenta (M) ink in the printhead 3 shown in FIG. 4A.

Figure 12A:
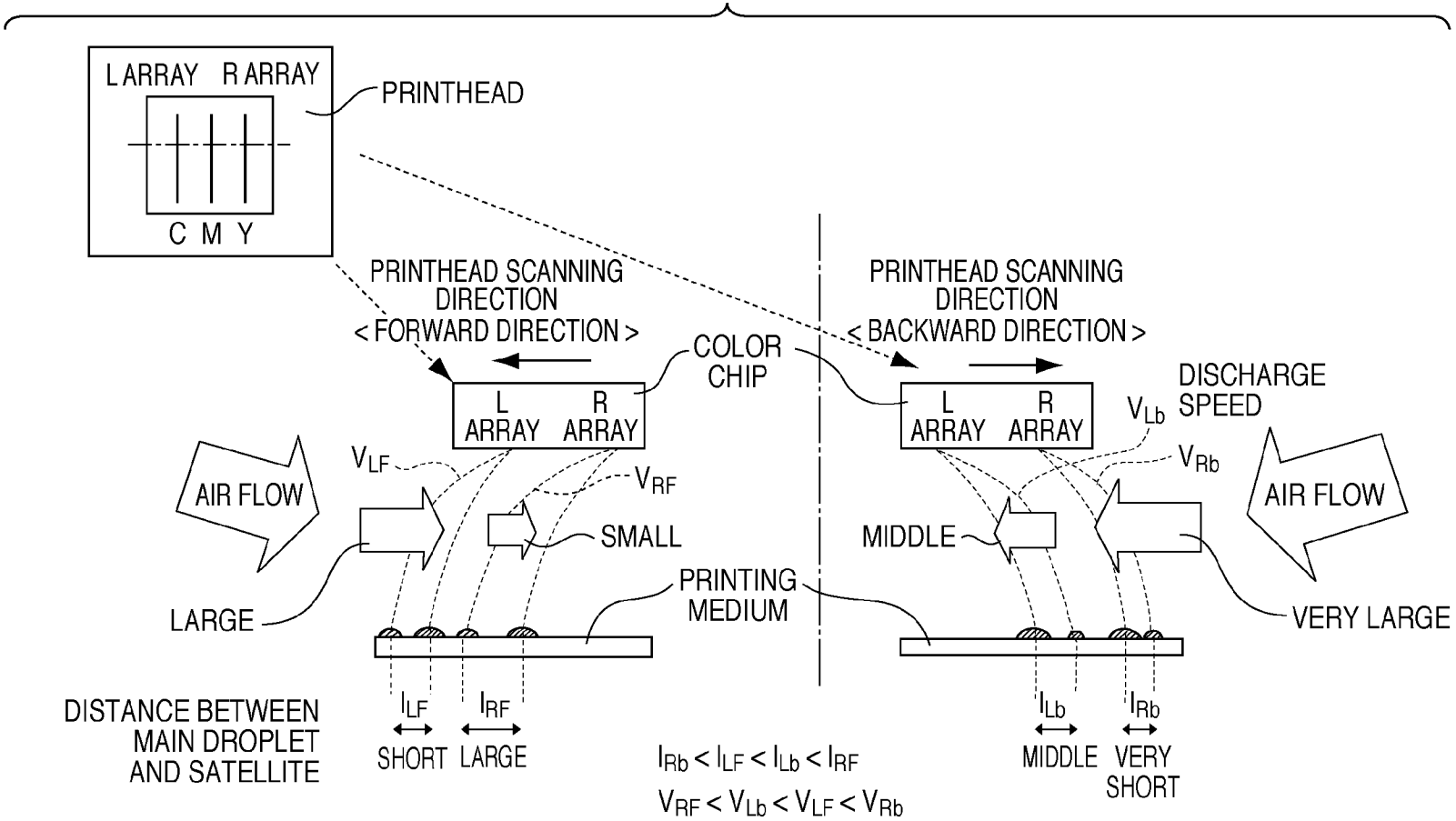
FIGS. 12A and 12B are views showing an outline of a conventional technique.
Figure 12B:
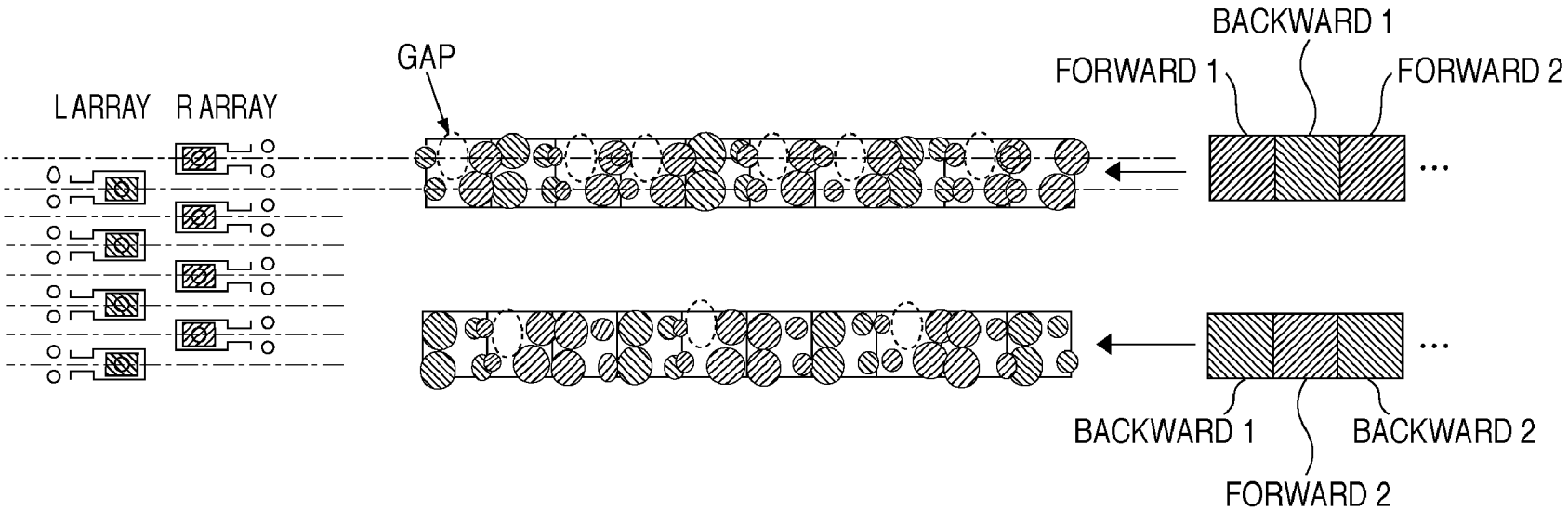

Assume that the distance between the main droplet and the satellite (to be also referred to as a main-satellite distance) in the forward direction becomes different from that in the backward direction upon executing conventional print processing, as shown in FIG. 12A. The main-satellite distance has a relationship "windward in the backward direction<windward in the forward direction<leeward in the backward direction<leeward in the forward direction". Thus, how the area factors are filled by main droplets and satellites differs greatly, especially between the leeward in the forward direction and that in the backward direction. More specifically, the leeward main-satellite distance in the forward direction is very long, and gaps greatly stand out, as shown in FIG. 12B. Hence, density nonuniformity is generated between adjacent bands.

Figure 4A:
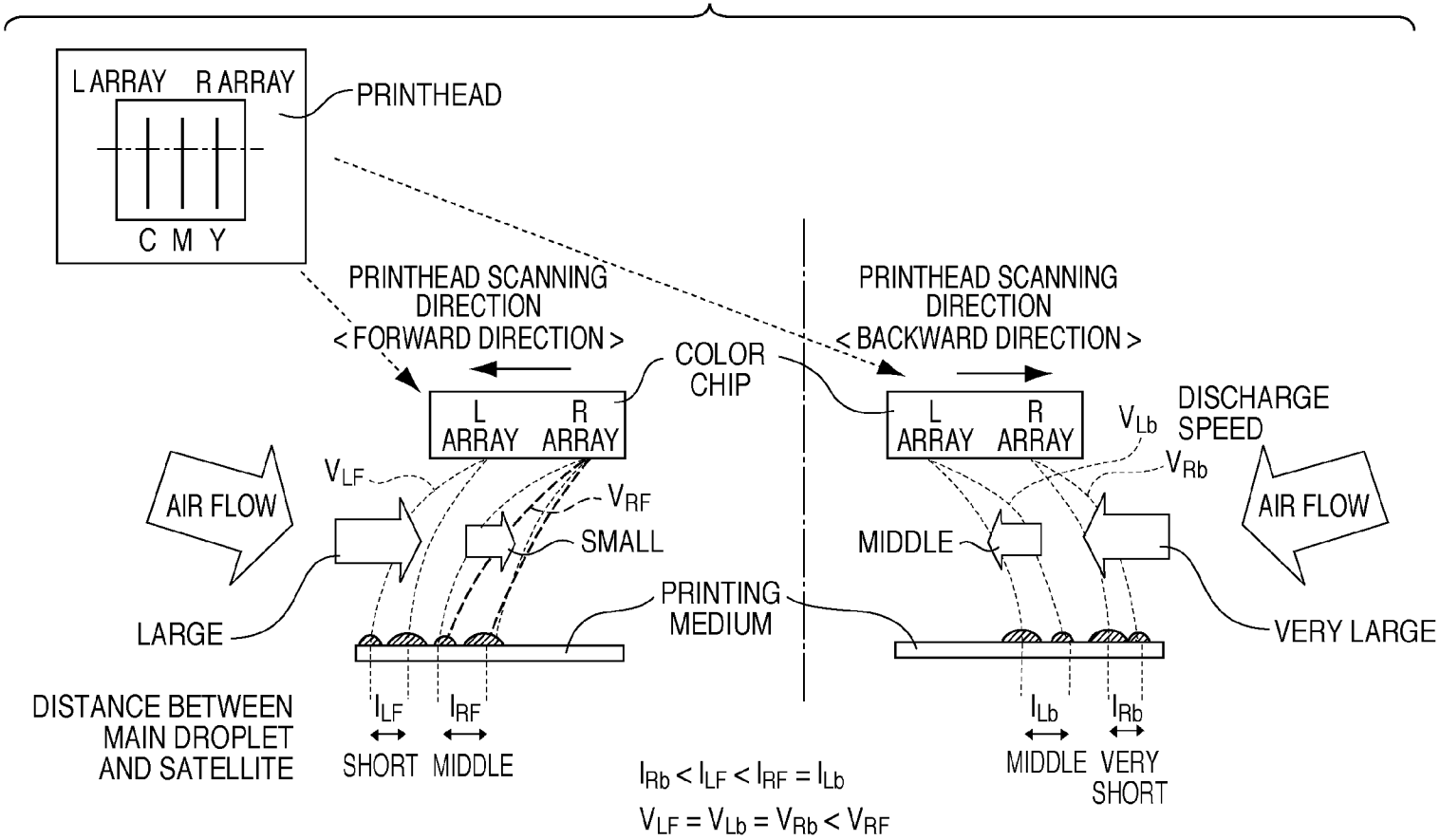
FIGS. 4A and 4B are views showing an outline of control of the discharge speed according to the first embodiment.

To address this issue, the first embodiment increases the discharge speed on the leeward (R array) in the forward direction. More specifically, the discharge speed on the leeward (R array) in the forward direction is set to be higher than or equal to that on the windward (L array) in the forward direction (in this case, the discharge speed on the leeward (R array)>that on the windward (L array) in the forward direction). This shortens the landing times of a main droplet and satellite discharged from the leeward in the forward direction, and shortens the time during which the air flow when scanning the printhead 3 affects the main droplet and satellite, as shown in FIG. 4A. Accordingly, the leeward main-satellite distance in the forward direction is reduced.

When the discharge speed is increased to shorten the time during which the air flow affects both the main droplet and satellite, it may seem that there is no reduction in the main-satellite distance. However, the satellite is smaller in volume than the main droplet and is readily affected by the air flow. A decrease in satellite flying distance therefore becomes larger than that in main droplet flying distance, reducing the main-satellite distance.

Figure 4B:
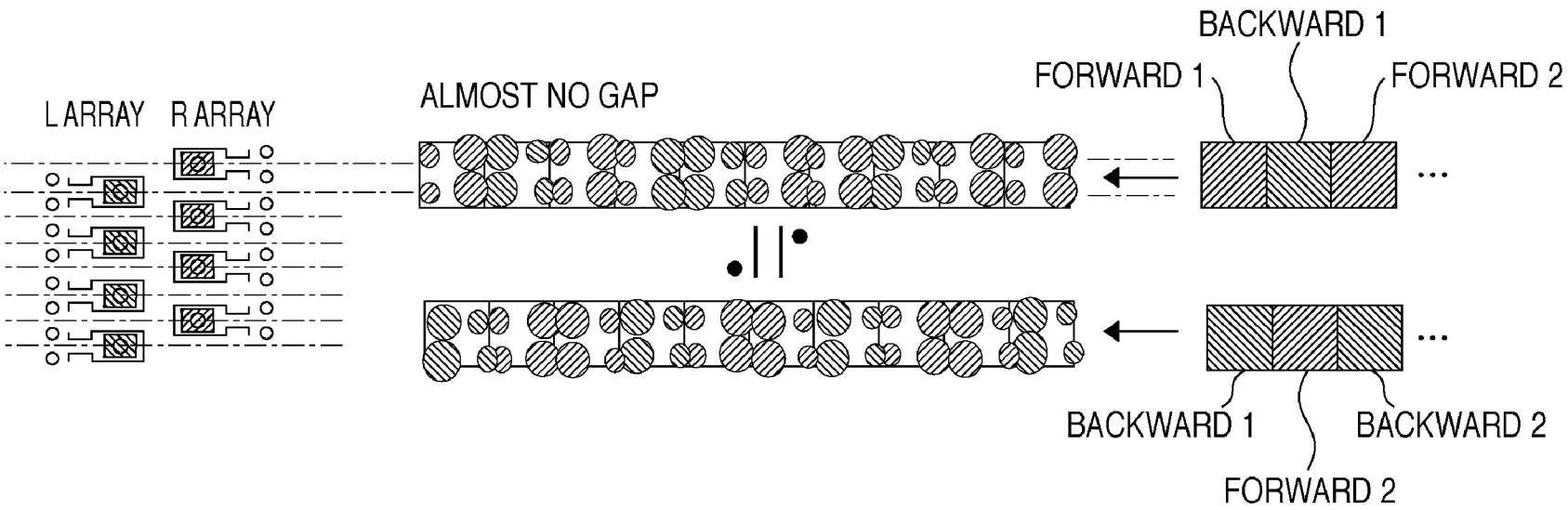

The discharge speed on the leeward (R array) in the forward direction is set to a value at which the main-satellite distance of this nozzle array and that of a leeward nozzle array in the backward direction become equal or have a difference within a predetermined range. With this setting, the main-satellite distance on the leeward (R array) in the forward direction and that on the leeward (L array) in the backward direction become almost equal (become equal or have a difference within a predetermined range), as shown in FIG. 4B. Thus, dots fill respective area factors equally.

A method of increasing the discharge speed in a heater driving circuit 30 described with reference to FIG. 2 will be now explained. To increase the discharge speed, it suffices to, for example, adjust the heat flux of the heater unit. Groups 1, . . . , M are assigned so that the R and L array sides of the printhead 3 can be controlled independently by a block selection signal. The widths of pulses sent from the HE terminal to the R and L array sides are modulated. Accordingly, the heat flux of the heater unit can be changed to control the discharge speed. In addition to the pulse width modulation, a voltage VH applied to the heater 37 may be controlled independently for the R and L array sides. In this case, the heat flux adjustment range becomes wide, so the discharge speed adjustment range also becomes wide.

As described above, according to the first embodiment, main-satellite distances in forward printing and backward printing are set to be equal or have a difference within a predetermined range so that dots fill respective area factors equally. This can suppress band nonuniformity caused by the difference in incoming air flow between forward printing and backward printing. This effect is enhanced as the ink discharge amount decreases.

(Second Embodiment)

The second embodiment will be described. A difference of the second embodiment from the first embodiment will be mainly explained to avoid a repetitive description of the contents.

Similar to the first embodiment, the incoming air flow has a relationship "windward in the backward direction>windward in the forward direction>leeward in the backward direction>leeward in the forward direction". In the second embodiment, how the area factors are filled by main droplets and satellites is further equalized between the windward in the forward direction and that in the backward direction, unlike the first embodiment. Note that a predetermined position on a printhead 3 according to the second embodiment is a nozzle array for discharging magenta (M) ink, similar to the first embodiment.

The second embodiment increases discharge speeds in forward printing (i.e., windward (L array) and leeward (R array) in the forward direction). In the second embodiment, discharge speeds on the windward (L array) and leeward (R array) in the forward direction are set to be almost equal (to be equal or have a difference within a predetermined range).

Figure 5A:
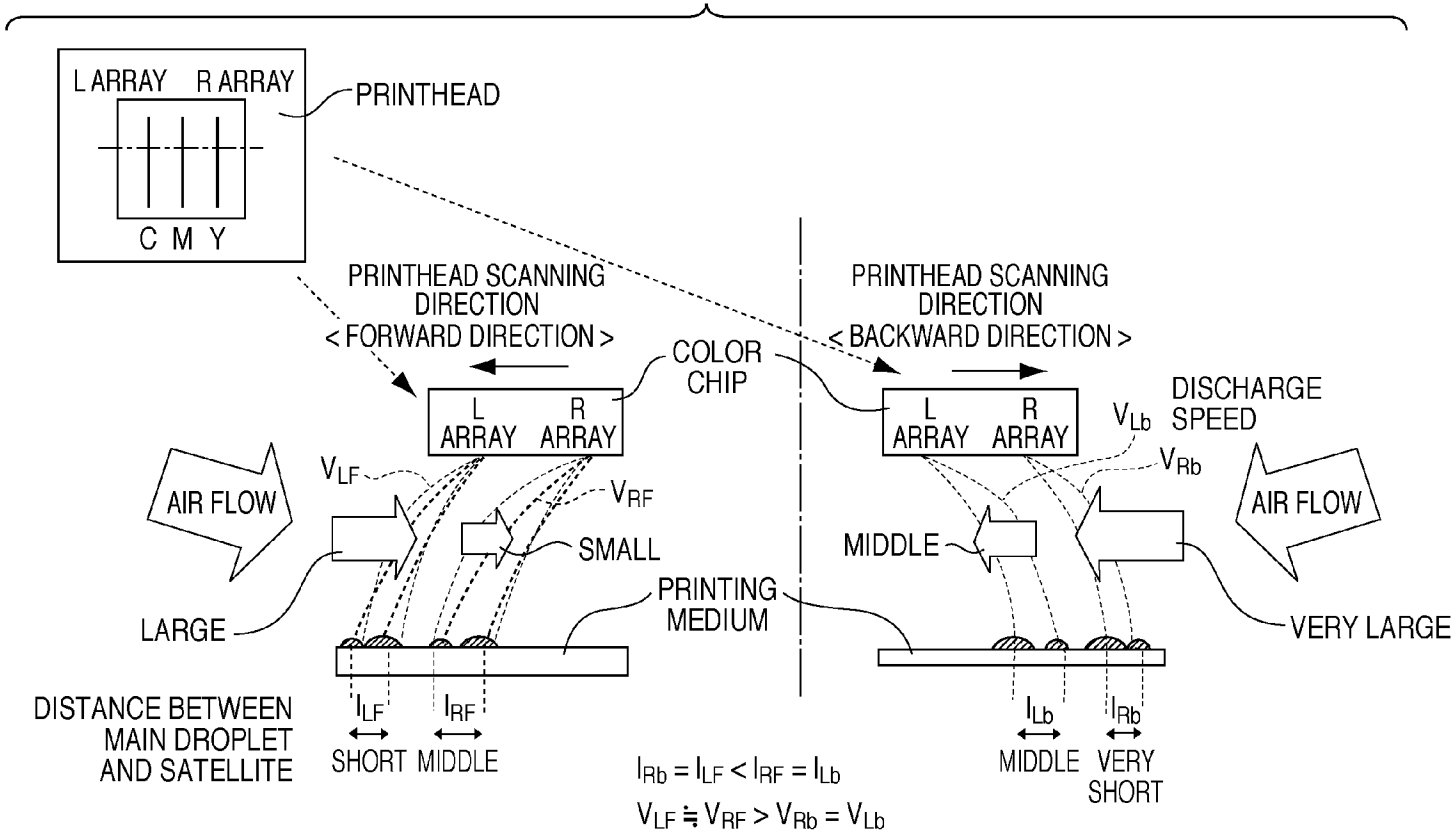
FIGS. 5A and 5B are views showing an outline of control of the discharge speed according to the second embodiment.

The discharge speed on the windward (L array) in the forward direction is set to a value at which the windward main-satellite distance in the forward direction and that in the backward direction become equal or have a difference within a predetermined range. This shortens the landing times of a main droplet and satellite discharged in the forward direction, and shortens the time during which the air flow upon scanning the printhead 3 affects the main droplet and satellite, as shown in FIG. 5A. As a consequence, the main-satellite distance in forward printing is reduced.

Figure 5B:
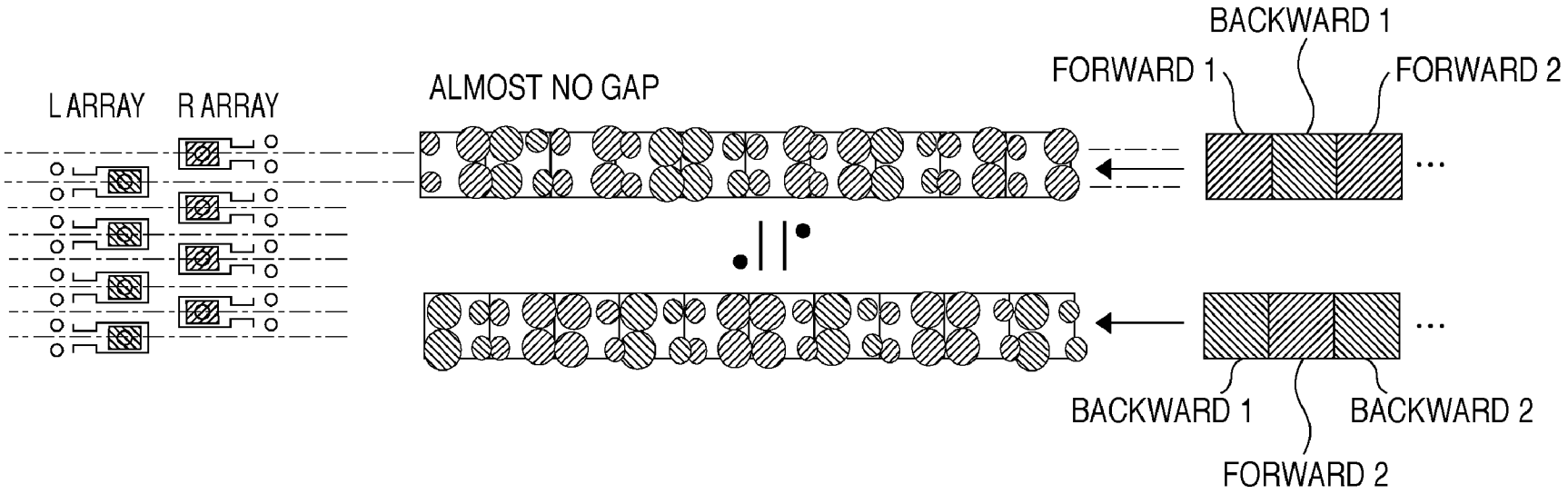

With this arrangement, the main-satellite distance on the leeward (R array) in the forward direction and that on the leeward (L array) in the backward direction become almost equal (become equal or have a difference within a predetermined range), as shown in FIG. 5B. The main-satellite distance on the windward (L array) in the forward direction and that on the windward (R array) in the backward direction also become almost equal (become equal or have a difference within a predetermined range). Thus, the area factors of dots become equal. Note that the method of increasing the discharge speed is the same as that described in the first embodiment, and a description thereof will not be repeated.

In addition to the effects of the first embodiment, the second embodiment can further suppress band nonuniformity caused by the difference in incoming air flow between forward printing and backward printing.

(Third Embodiment)

The third embodiment will be described. A difference of the third embodiment from the first embodiment will be mainly explained to avoid a repetitive description of the contents. Note that a predetermined position on a printhead 3 according to the third embodiment is a nozzle array for discharging magenta (M) ink, similar to the first embodiment.

Similar to the first embodiment, the incoming air flow has a relationship "windward in the backward direction>windward in the forward direction>leeward in the backward direction>leeward in the forward direction". In the third embodiment, how the area factors are filled by all main droplets and satellites is equal in the forward and backward directions and on the windward and leeward.

Figure 6A:
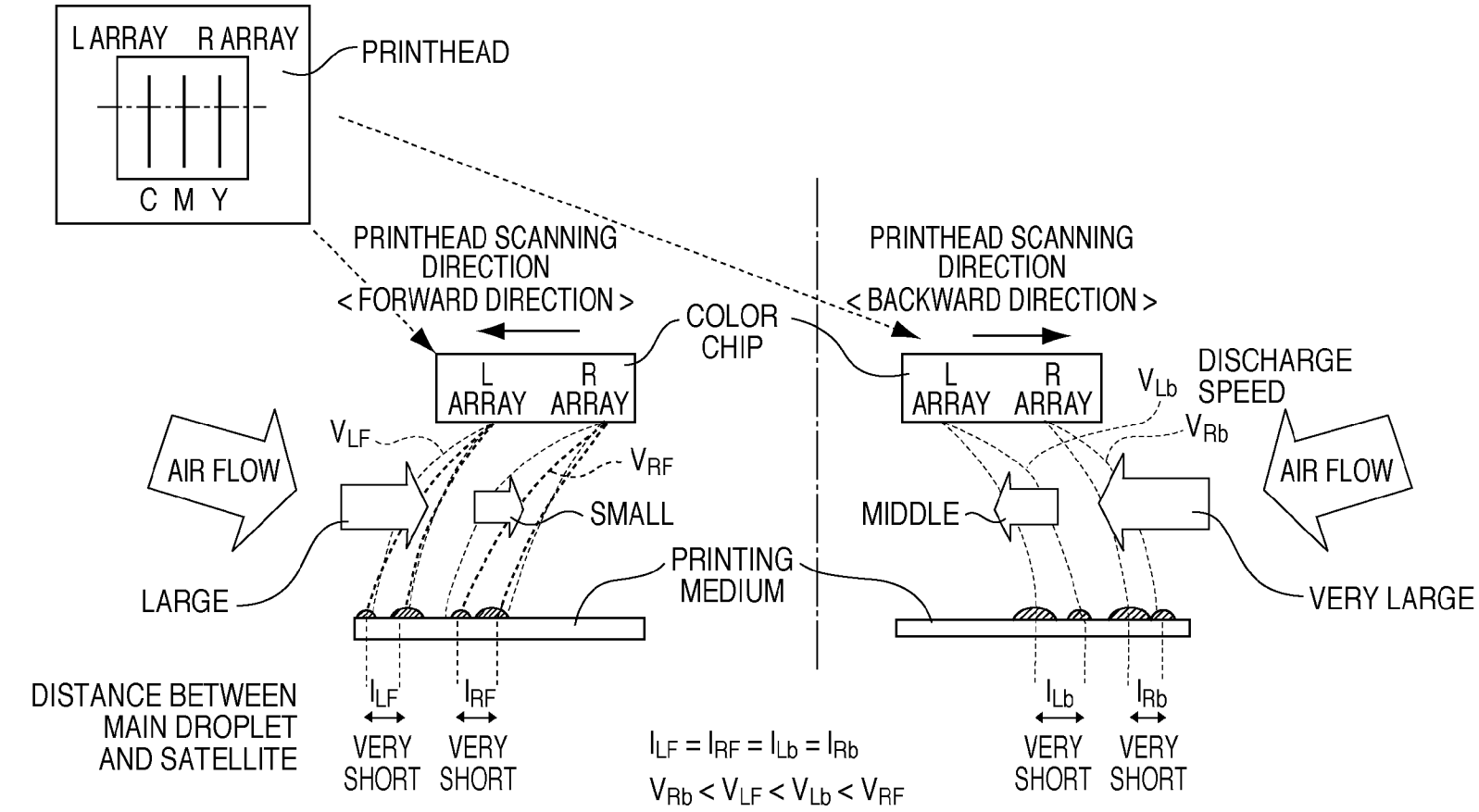
FIGS. 6A to 6C are views showing an outline of control of the discharge speed according to the third embodiment.

The third embodiment increases, as incoming air flow for a nozzle array becomes weaker, the discharge speed of ink discharged from the nozzle. More specifically, the discharge speed is increased in the order of "windward in the backward direction>windward in the forward direction>leeward in the backward direction>leeward in the forward direction". These discharge speeds are set to values at which the main-satellite distances of dots discharged from the windward and leeward in both the forward and backward directions become equal or have a difference within a predetermined range. In this case, as the incoming air flow becomes weaker, the landing times of a main droplet and satellite discharged from each nozzle array becomes shorter, shortening the time during which the air flow upon scanning the printhead 3 affects the main droplet and satellite, as shown in FIG. 6A.

Figure 6B:
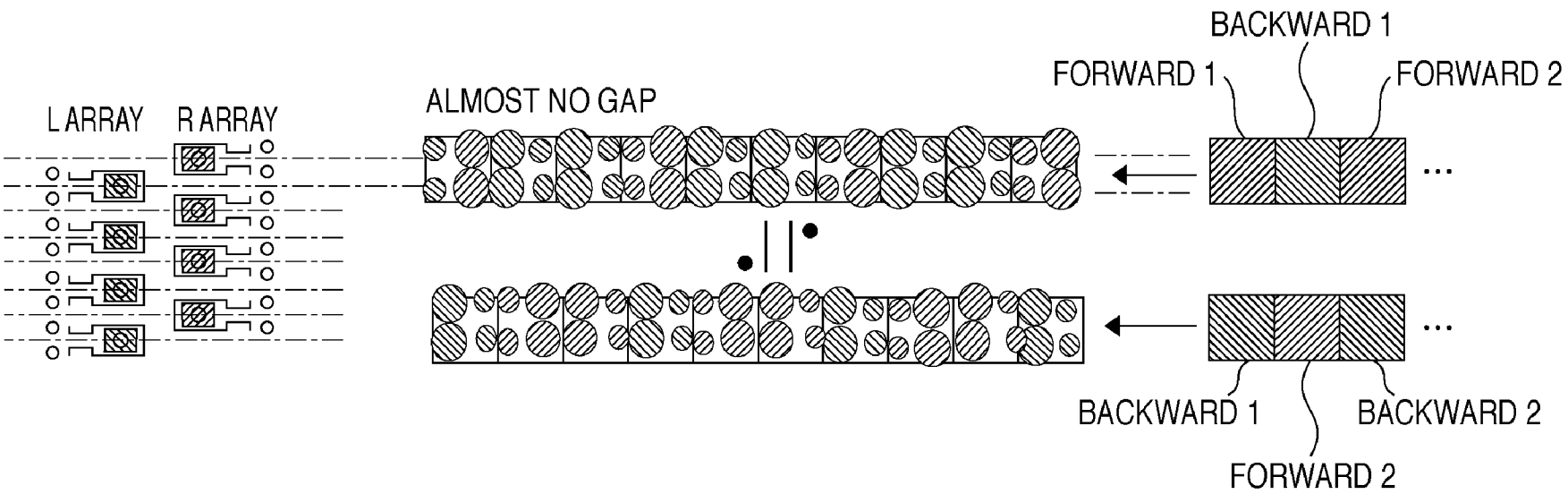

As the incoming air flow becomes weaker, this arrangement reduces the main-satellite distance more than that in the conventional arrangement, and all main-satellite distances in the forward and backward directions become almost equal (become equal or have a difference within a predetermined range), as shown in FIG. 6B. Resultantly, dots fill respective area factors equally.

Figures 6C, 7:
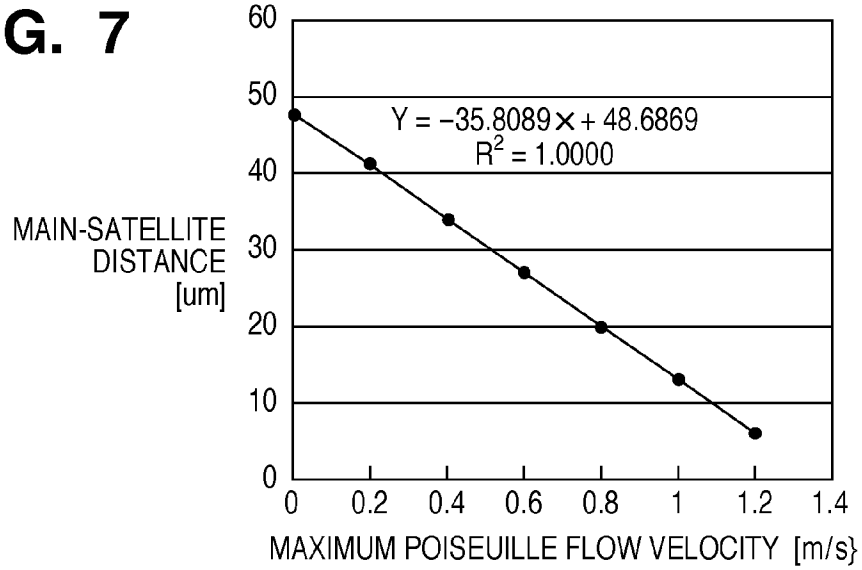
FIG. 7 is a table showing an example of the relationship between the incoming air flow rate and the main-satellite distance.

Note that the method of increasing the discharge speed is the same as that described in the first embodiment, and a description thereof will not be repeated. Experimental results when controlling the discharge speed according to the method of the third embodiment will be explained with reference to FIG. 6C. FIG. 6C shows experimental results when the discharge speed is controlled and is not controlled. When the discharge speed is controlled, main-satellite distances in the backward and forward directions become equal, compared to those when no discharge speed is controlled, though the distances slightly vary.

A concrete control method in the third embodiment will be explained. First, conditions in the third embodiment are a discharge amount of 1.2 ng and a discharge speed of 11 m/s (satellite speed of 7.5 m/s) for both the R and L nozzle arrays, and a head-sheet distance of 1.2 mm. Under these conditions, as shown in FIG. 6C, the main-satellite distance is 47 μm for the R array in the forward direction for which the incoming air flow is minimum, and 36 μm for the R array in the backward direction for which the incoming air flow is maximum. These actually measured values are applied to the above-mentioned theoretical formula, obtaining a relationship shown in FIG. 7 between the incoming air flow rate and the main-satellite distance. At this time, the incoming air flow rate is about 0 to 0.1 m/s for the R array in the forward direction for which the incoming air flow is minimum, and about 0.3 to 0.4 m/s for the R array in the backward direction for which the incoming air flow is maximum.

In this case, when the discharge speed of the R array in the forward direction for which the incoming air flow is minimum is set to 15 m/s, a satellite speed of 9.7 m/s and a main-satellite distance of 37 μm are actually measured. This main-satellite distance substantially coincides with a main-satellite distance of 36 μm for the R array in the backward direction for which the incoming air flow is maximum. From this, in the embodiment, it is controlled to set a pulse width (application time) Pw of 0.8 μsec to 1.2 μsec in order to increase the discharge speed of the R array in the forward direction from 11 m/s to 15 m/s.

In addition to the effects of the first embodiment, the third embodiment can further suppress band nonuniformity arising from the difference in incoming air flow between forward printing and backward printing.

(Fourth Embodiment)

The fourth embodiment will be described. A difference of the fourth embodiment from the first embodiment will be mainly explained to avoid a repetitive description of the contents. Note that a predetermined position on a printhead 3 according to the fourth embodiment is a nozzle array for discharging yellow (Y) ink shown in FIG. 8A.

Figure 8A:
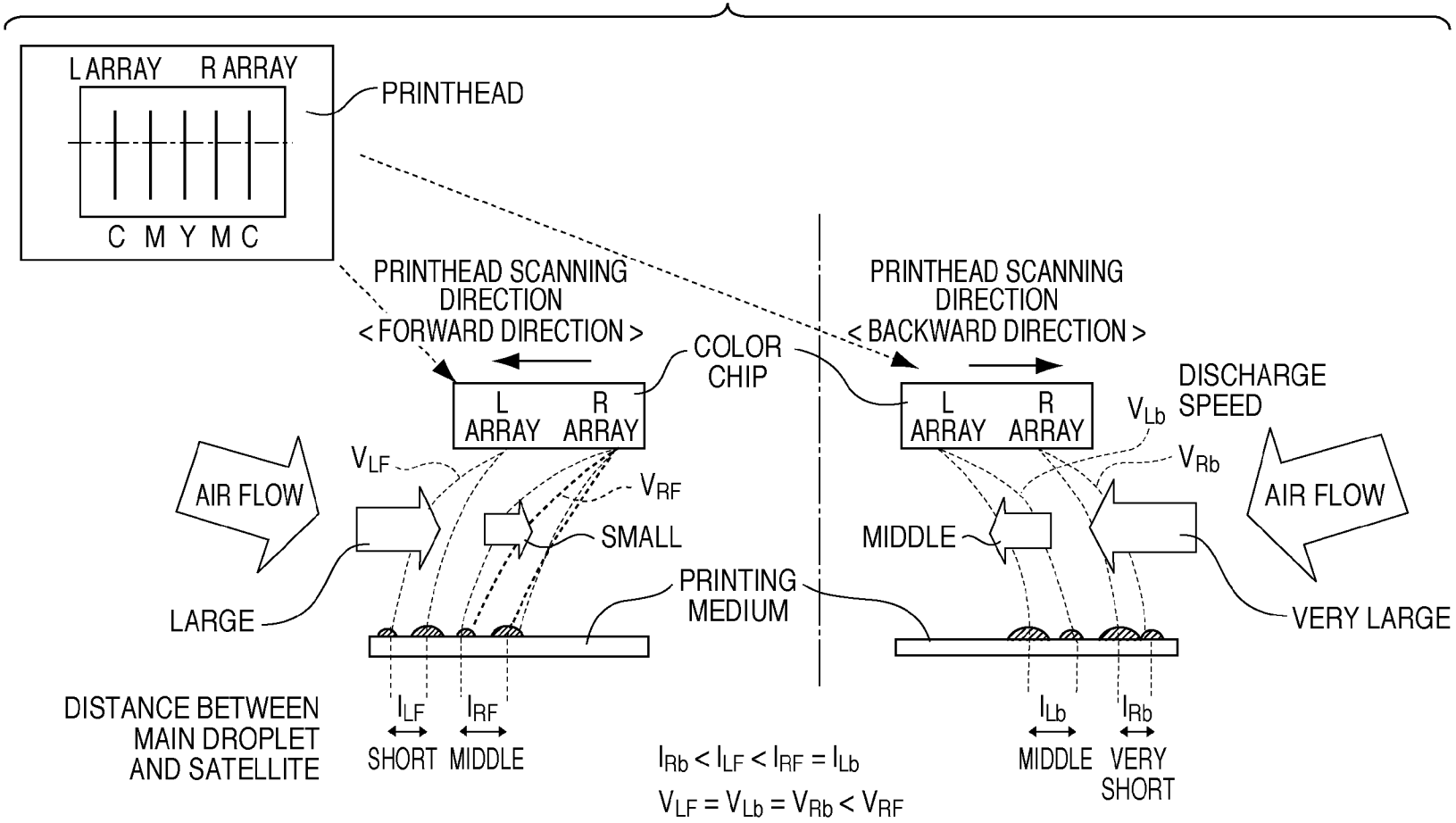
FIGS. 8A and 8B are views showing an outline of control of the discharge speed according to the fourth embodiment.

As the printhead 3, the fourth embodiment employs a printhead (to be referred to as a bidirectional head) formed from bidirectional nozzle arrays. In the printhead 3 according to the fourth embodiment, nozzle arrays of the same color are arranged axisymmetrically, as shown in FIG. 8A. In general, the bidirectional head is more highly likely to generate nonuniformity than the printhead described in the first embodiment because band nonuniformity appears even in a pattern printed in only a single color. This applies to both C arrays and M arrays each having an axial symmetrical arrangement. To avoid a repetitive description, C arrays (L and R arrays) will be exemplified.

Similar to the first embodiment, the incoming air flow has a relationship "windward in the backward direction>windward in the forward direction>leeward in the backward direction>leeward in the forward direction". The fourth embodiment increases the discharge speed on the leeward (R array) in the forward direction. The discharge speed on the leeward (R array) in the forward direction is set to a value at which the leeward main-satellite distance in the forward direction and that in the backward direction become equal or have a difference within a predetermined range. This shortens the landing times of a main droplet and satellite discharged from the leeward in the forward direction, and shortens the time during which the air flow upon scanning the printhead 3 affects the main droplet and satellite, as shown in FIG. 8A. Therefore, the leeward main-satellite distance in the forward direction is reduced.

Figure 8B:
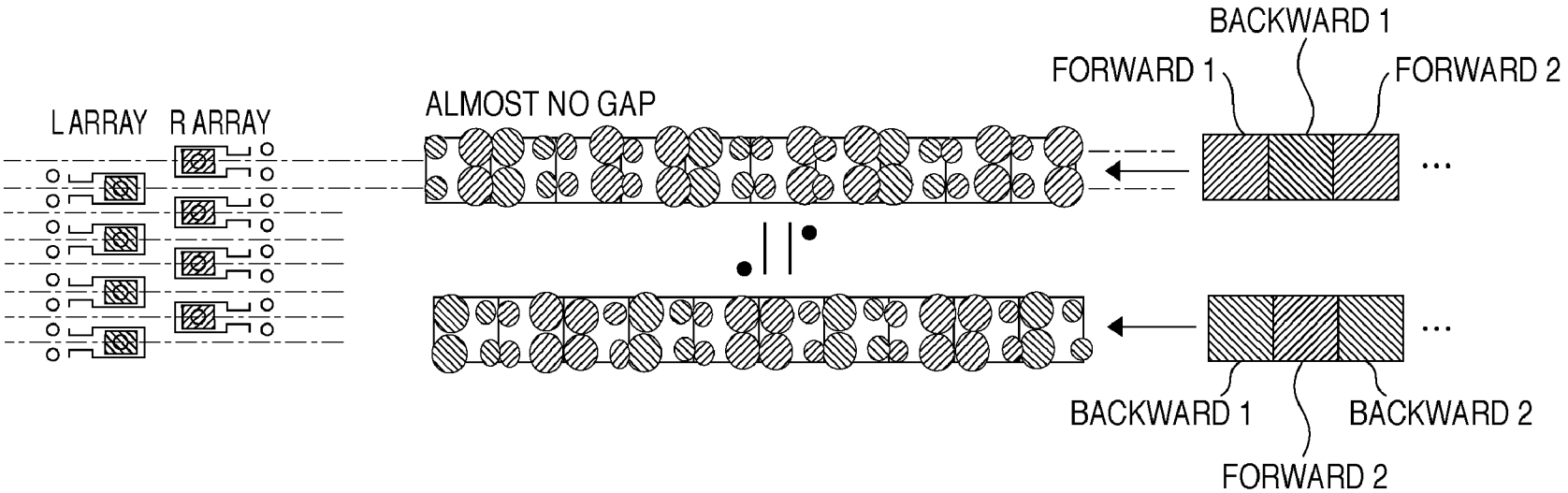

With this arrangement, the main-satellite distance on the leeward (R array) in the forward direction and that on the leeward (L array) in the backward direction become almost equal (become equal or have a difference within a predetermined range), as shown in FIG. 8B. Thus, how the area factors are filled by dots becomes equal. Note that the method of increasing the discharge speed is the same as that described in the first embodiment, and a description thereof will not be repeated.

As described above, the fourth embodiment can obtain the same effects as those of the first embodiment even when the bidirectional head is employed.

Preferred embodiments of the present invention have been described. However, the present invention is not limited to these embodiments, and various changes and modifications can be made without departing from the scope of the invention.

Figure 9A:
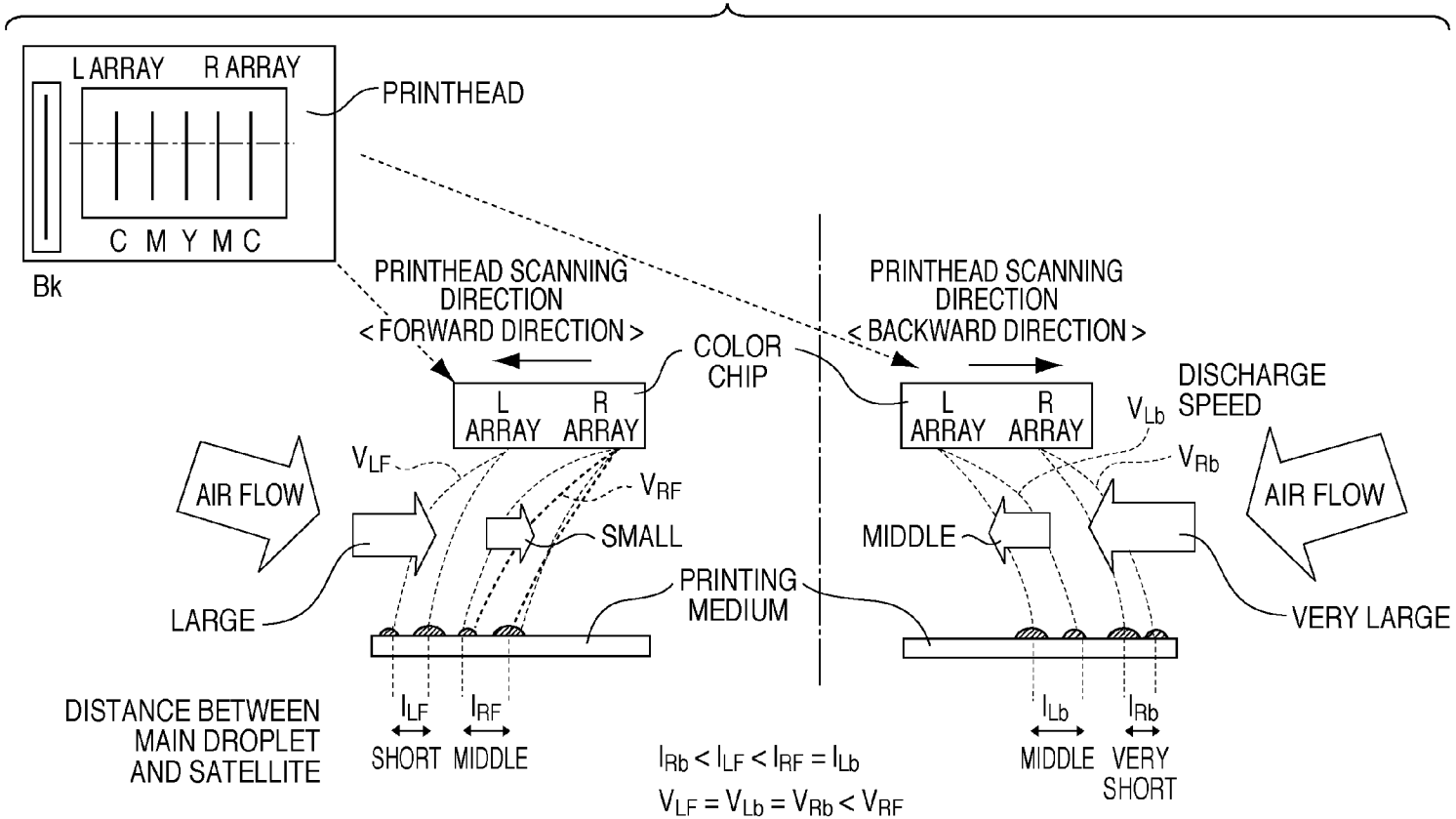
FIGS. 9A and 9B are views showing an outline of control of the discharge speed according to a modification of the embodiment.
Figure 10A:
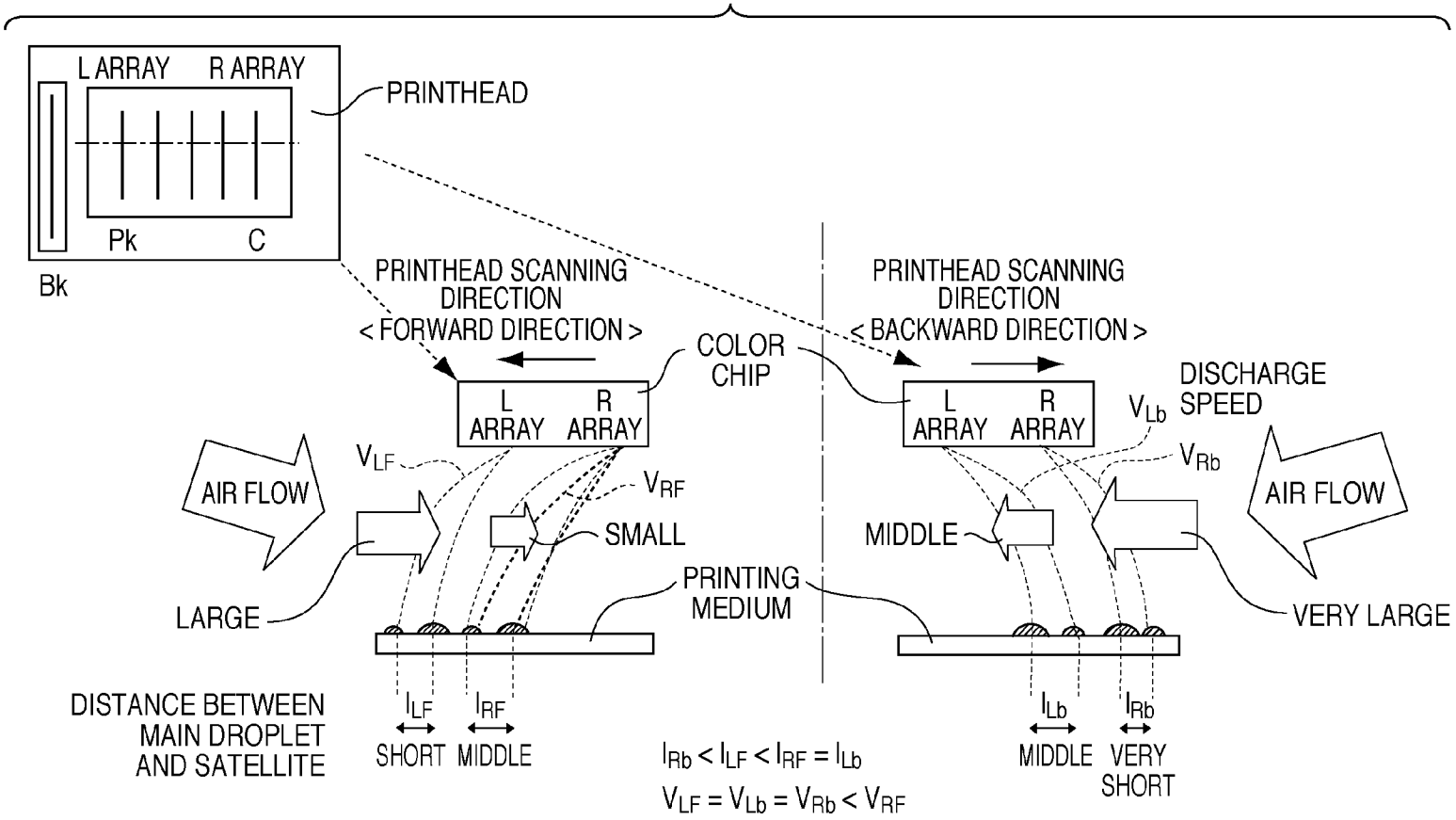
FIGS. 10A and 10B are views showing an outline of control of the discharge speed according to a modification of the embodiment.

For example, the printhead 3 is not limited to the foregoing nozzle arrangement. For example, a black ink discharge nozzle (Bk) may be added as shown in FIG. 9A. Alternatively, a black ink discharge nozzle (Bk) and pink ink discharge nozzle (Pk) may be added as shown in FIG. 10A. Adding Pk can improve, for example, tonality and color gamut representation.

The volume of the incoming air flow sometimes changes depending on a combination of the internal shape (e.g., the recovery mechanism at the home position) of the main body and the printhead shape (e.g., the positional relationship between Bk and Pk nozzles). In the arrangements shown in FIGS. 9A and 10A, the volume of the incoming air flow does not change before and after these nozzles are arranged. Incoming air flows in the forward and backward directions and on the windward and leeward change upon a change of the arrangement. In consideration of this, information regarding the incoming air flow needs to be set in the ROM or the like (e.g., the ROM 602).

Figure 9B:
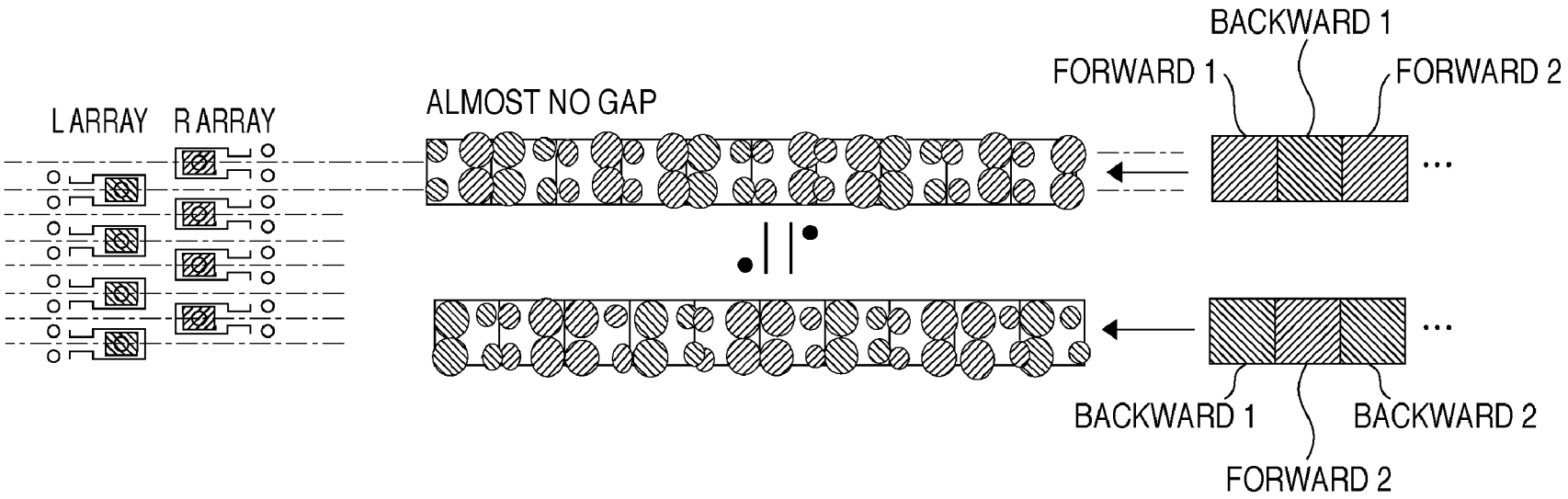
Figure 10B:
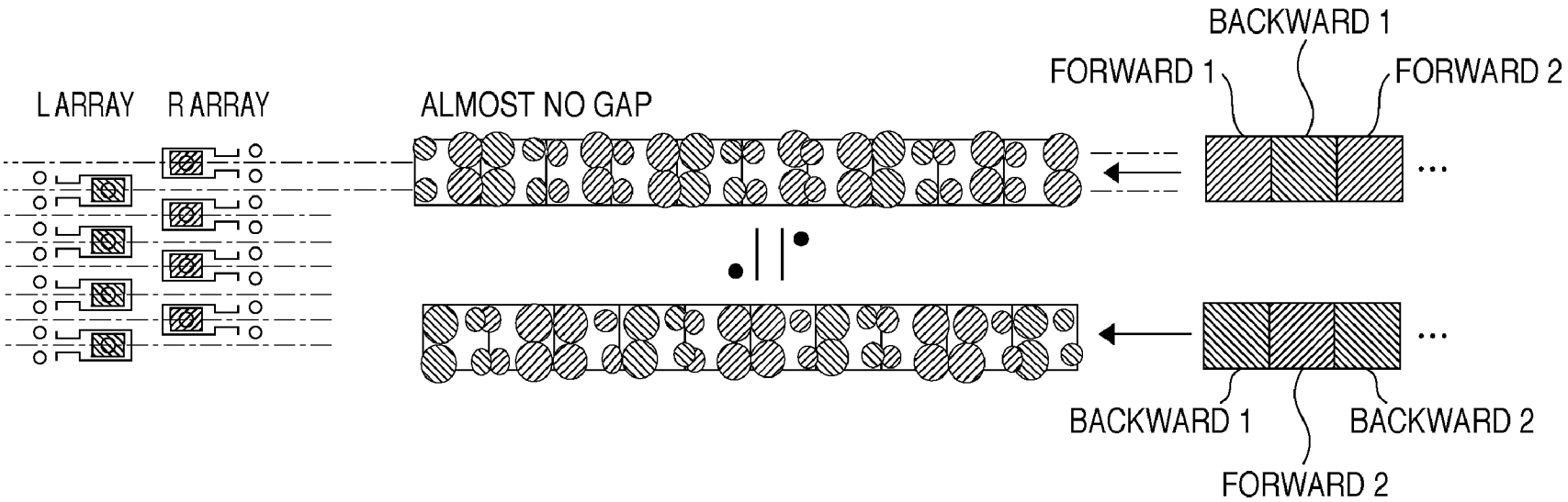
Figure 11A:
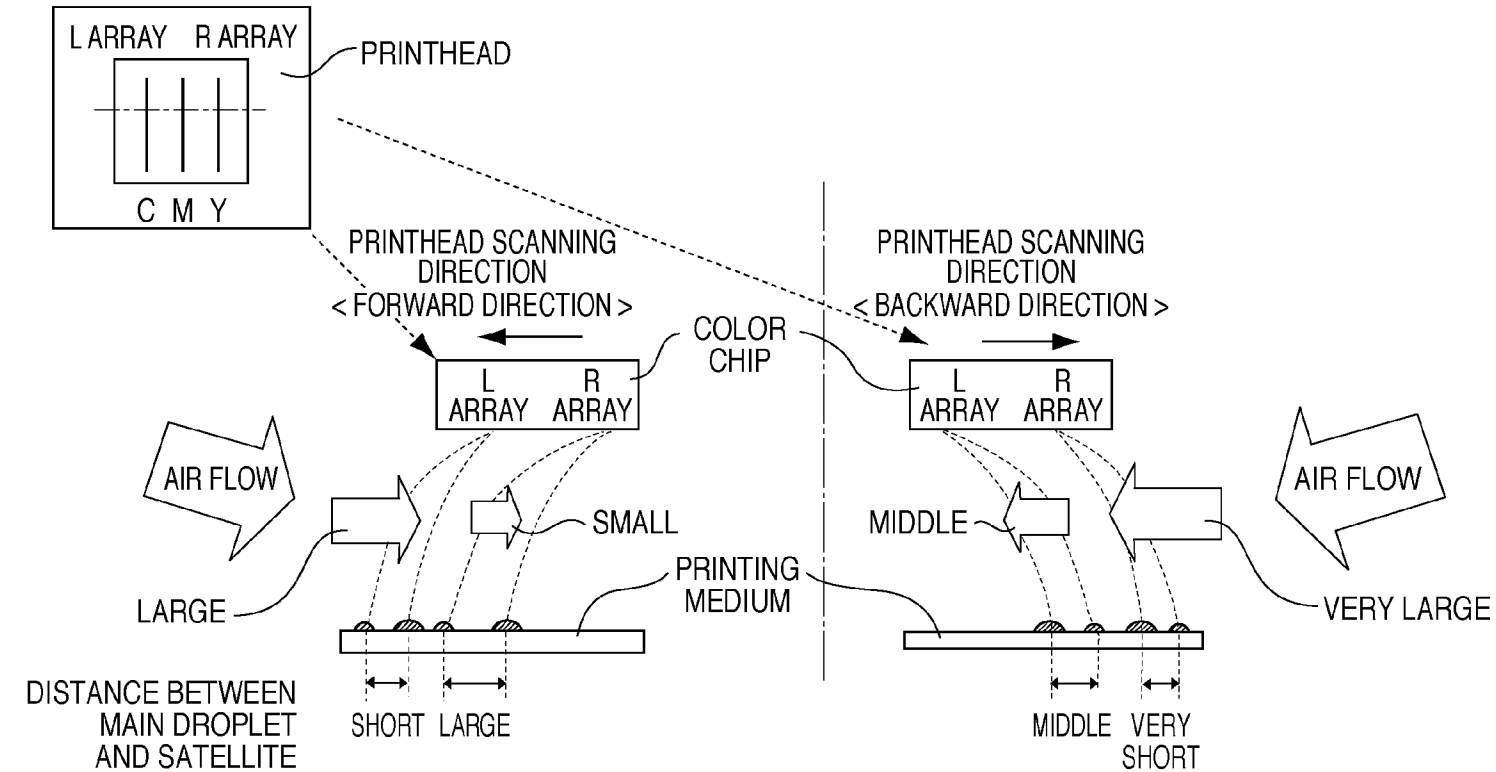
FIGS. 11A to 11C are views showing an outline of a conventional technique.
Figure 11B:
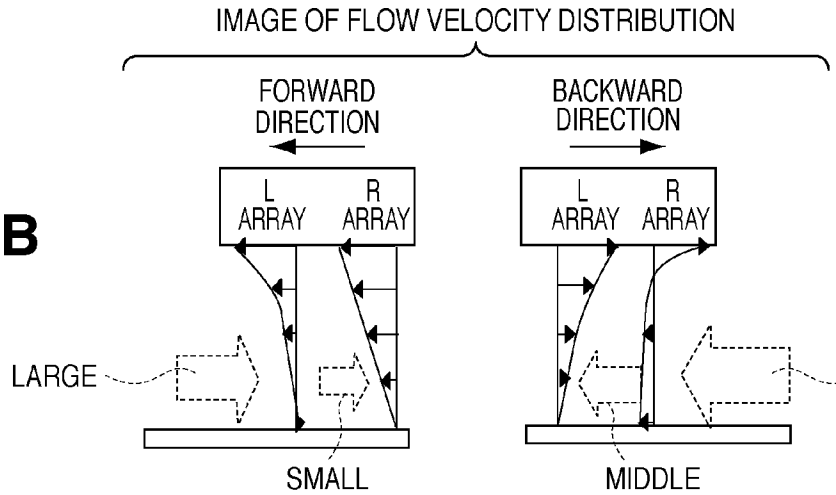
Figure 11C:
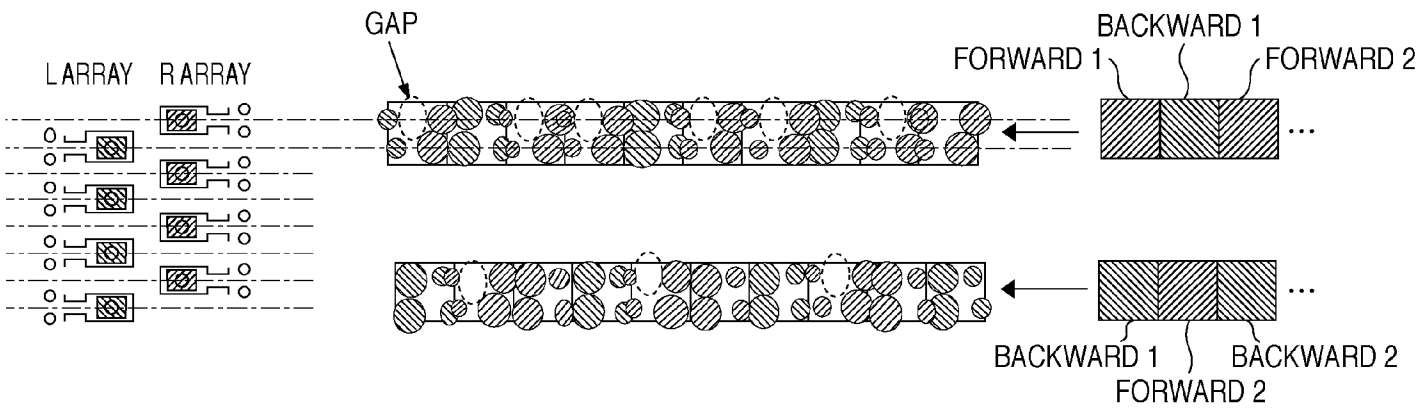

When the incoming air flows shown in FIGS. 9A and 10A are generated, it suffices to cope with them by, for example, increasing the discharge speed on the leeward (R array) in the forward direction, similar to the first embodiment. As shown in FIGS. 9B and 10B, the main-satellite distance on the leeward (R array) in the forward direction and that on the leeward (L array) in the backward direction become almost equal (become equal or have a difference within a predetermined range). Thus, how the area factors are filled by dots becomes equal.

The present invention can therefore suppress band nonuniformity arising from the difference in incoming air flow between forward printing and backward printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-118038 filed on May 14, 2009, which is hereby incorporated by reference herein in its entirety.

What is claimed is:

1. A printing apparatus comprising:

a printing unit configured to print on a printing medium by scanning a printhead having a plurality of nozzle arrays in a first direction and a second direction opposite to the first direction, a holding unit configured to hold information regarding an air flow in the scan of the first direction and in the scan of the second direction; and a changing unit configured to change discharge speeds of ink from the plurality of nozzle arrays based on the information regarding the air flow that is held in said holding unit and a scanning direction of the printhead, wherein the printing apparatus has a structure in which an air flow entering the nozzle array in the scan of the printhead in the first direction becomes larger than an air flow entering the nozzle array in the scan of the printhead in the second direction, and in scanning in the second direction, said changing unit increases the discharge speed of ink discharged from at least one nozzle array arranged leeward in the scanning direction of the printhead from a predetermined position on the printhead in the scanning direction to be higher than or equal to the discharge speed of ink discharged from at least one nozzle array arranged windward in the scanning direction of the printhead from the predetermined position.

2. The apparatus according to claim 1, wherein in scanning in the second direction, said changing unit increases the discharge speed of ink discharged from at least one nozzle array arranged leeward in the scanning direction of the printhead from the predetermined position on the printhead in the scanning direction to be higher than the discharge speed of ink discharged from at least one nozzle array arranged windward in the scanning direction of the printhead from the predetermined position.

3. The apparatus according to claim 1, wherein in scanning in the second direction, said changing unit increases the discharge speeds of ink from the plurality of nozzle arrays to be higher than the discharge speeds in scanning in the first direction.

4. The apparatus according to claim 1, wherein in scanning in the first direction and scanning in the second direction, said changing unit increases, as inflow of the air flow for a nozzle array becomes smaller, the discharge speed of ink discharged from the nozzle array.

5. The apparatus according to claim 1, wherein the printhead consists of bidirectional nozzle arrays which are axisymmetrically arranged for the same color in a direction perpendicular to the scanning direction.

6. The apparatus according to claim 1, wherein the printhead prints by scanning the same printing area on the printing medium by an odd number of times.

7. The apparatus according to claim 1, wherein the printhead includes a heater driving circuit which controls driving of a heater for generating thermal energy to be applied to ink to discharge ink using the thermal energy, and said changing unit changes the discharge speed by controlling a control signal to the heater driving circuit and changing a heat flux of the heater.

8. A control method for a printing apparatus comprising:

printing on a printing medium by scanning a printhead having a plurality of nozzle arrays in a first direction and a second direction opposite to the first direction, holding information regarding an air flow in the scan of the first direction and in the scan of the second direction; and changing discharge speeds of ink from the plurality of nozzle arrays based on the held information regarding the air flow and a scanning direction of the printhead, wherein the printing apparatus has a structure in which an air flow entering the nozzle array in the scan of the printhead in the first direction becomes larger than an air flow entering the nozzle array in the scan of the printhead in the second direction, and in the changing, in scanning in the second direction, the discharge speed of ink discharged from at least one nozzle array arranged leeward in the scanning direction of the printhead from a predetermined position on the printhead in the scanning direction is increased to higher than or equal to the discharge speed of ink discharged from at least one nozzle array arranged windward in the scanning direction of the printhead from the predetermined position.

* * * * *